US009745948B1

(12) United States Patent
Koepsel

(10) Patent No.: US 9,745,948 B1
(45) Date of Patent: Aug. 29, 2017

(54) MARINE PROPELLER AND METHOD OF DESIGN THEREOF

(71) Applicant: Brunswick Corporation, Lake Forest, IL (US)

(72) Inventor: Roger E. Koepsel, Oshkosh, WI (US)

(73) Assignee: Brunswick Corporation, Lake Forest, IL (US)

( * ) Notice: Subject to any disclaimer, the term of this patent is extended or adjusted under 35 U.S.C. 154(b) by 420 days.

(21) Appl. No.: 14/317,409

(22) Filed: Jun. 27, 2014

Related U.S. Application Data

(60) Provisional application No. 61/871,984, filed on Aug. 30, 2013.

(51) Int. Cl.
*F03B 3/12* (2006.01)

(52) U.S. Cl.
CPC ..... *F03B 3/121* (2013.01)

(58) Field of Classification Search
CPC ... F03B 3/12; F03B 3/121; B63H 1/14; B63H 1/18; B63H 1/26
See application file for complete search history.

(56) References Cited

U.S. PATENT DOCUMENTS 3,589,833 A * 6/1971 Lancioni ..... B63H 1/18 416/193 R
3,788,267 A 1/1974 Strong
3,938,463 A * 2/1976 Hecker ..... B63H 5/07 416/202
4,080,099 A 3/1978 Snyder
4,331,429 A 5/1982 Koepsel et al.
4,767,278 A * 8/1988 Enderlein, Jr. ..... B63H 1/14 416/241 B
4,780,058 A 10/1988 Phillips
(Continued)

FOREIGN PATENT DOCUMENTS

AU CA 2405497 A1 * 5/2001 ..... B63H 1/26
CA 2675044 A1 * 1/2011 ..... B63H 1/26

OTHER PUBLICATIONS

Ukon, Yoshitaka, Research on Design and Application of Super-Cavitating Propellers, paper, 1996, SRI, vol. 33, No. 3, p. 151-180 (in Japanese accessed through Google search, citation available through National Maritime Research Institute).
(Continued)

*Primary Examiner* — Nathaniel Wiehe
*Assistant Examiner* — Eric Zamora Alvarez
(74) *Attorney, Agent, or Firm* — Andrus Intellectual Property Law, LLP

(57) ABSTRACT

A marine propeller has an outer hub having a central axis and a blade having a blade root attached to the outer hub and extending radially outward from the outer hub toward a blade tip. The blade has a leading edge and a trailing edge. The propeller has a diameter between about 15 inches and about 17 inches and a pitch between about 14 inches and about 24 inches. The blade has a progressive rake angle such that a first local rake angle at the blade root is less than a second local rake angle at the blade tip. A combination of the diameter, pitch, and progressive rake angle provides a marine vessel to which the marine propeller is coupled with minimum drag while the marine vessel is operating at less than a maximum vessel speed. A method of designing a propeller is also disclosed.

17 Claims, 14 Drawing Sheets

(56) References Cited

U.S. PATENT DOCUMENTS

| | | | | |
|---|---|---|---|---|
| 4,789,306 | A | 12/1988 | Vorus et al. | |
| 4,802,822 | A | 2/1989 | Gilgenbach et al. | |
| 4,865,520 | A | 9/1989 | Hetzel et al. | |
| D319,210 | S | 8/1991 | Koepsel et al. | |
| 5,104,292 | A | 4/1992 | Koepsel et al. | |
| 5,114,313 | A | 5/1992 | Vorus | |
| 5,158,433 | A | 10/1992 | Cleary | |
| 5,236,310 | A | 8/1993 | Koepsel et al. | |
| 5,290,147 | A * | 3/1994 | Karls | B63H 3/008 416/137 |
| 5,352,093 | A | 10/1994 | Hannon et al. | |
| 5,368,508 | A | 11/1994 | Whittington | |
| 5,405,243 | A | 4/1995 | Hurley et al. | |
| 5,464,321 | A | 11/1995 | Williams et al. | |
| D368,886 | S | 4/1996 | Kuryliw | |
| 5,527,195 | A | 6/1996 | Neisen | |
| 5,791,874 | A | 8/1998 | Lang | |
| 5,807,151 | A * | 9/1998 | Sumino | B63H 1/26 416/129 |
| D442,906 | S | 5/2001 | Prokop | |
| 6,390,776 | B1 | 5/2002 | Gruenwald | |
| 6,699,016 | B1 | 3/2004 | Dean | |
| 6,837,757 | B2 * | 1/2005 | Van Dine | B63H 23/24 310/87 |
| 7,025,642 | B1 | 4/2006 | Baylor | |
| 7,637,722 | B1 | 12/2009 | Koepsel et al. | |
| 2005/0175458 | A1 | 8/2005 | Vazquez | |
| 2005/0233654 | A1 | 10/2005 | Mueller | |
| 2010/0000461 | A1 * | 1/2010 | Waite | B63B 1/248 114/274 |
| 2011/0091328 | A1 * | 4/2011 | Powers | B63H 1/26 416/236 R |

OTHER PUBLICATIONS

Man Diesel and Turbo, Basic Principles of Ship Propulsion, paper, Dec. 2011, p. 18-19, Denmark.

Savitsky, Daniel, Hydrodynamic Design of Planing Hulls, reprinted from Marine Technology, 1964, vol. 1, No. 1, p. 71-95, United States.

"The Hull Truth Boating Forum", webpage discussion, Mar. 16, 2008, available at http://www.thehulltruth.com/boating-forum/166806-prop-pitch-fuel-economy.html#b.

Falvey, Kevin, "Tips on How to Save Fuel", web article, Mar. 9, 2011, available at http://www.boatingmag.com/expert-tips-saving-fuel#page-2.

Manitou Pontoon Boats, "How to Save Fuel in your Boat—Boating Fuel Efficiency Tips", web article, Oct. 21, 2011, available at https://www.manitoupontoonboats.com/how-to-save-fuel-in-your-boat-boating-fuel-efficiency-tips/.

Burden, Tom, "Selecting a Propeller", web article, available at least as early as Apr. 24, 2014, available at https://www.westmarine.com/WestAdvisor/Selecting-a-Propeller.

Dang et al., "The Wageningen C- and D-Series Propellers", conference paper, Nov. 1, 2013, available at http://www.marin.nl/web/News/News-items/Wageningen-C-and-Dseries-propellers.htm.

Techet, A.H., "13.012 Hydrodynamics for Ocean Engineers", textbook chapter, Nov. 30, 2004, available at http://web.mit.edu/13.012/www/handouts/propellers_reading.pdf.

Carlton, John, "Marine Propellers and Propulsion", book, 2007, pp. 39-42, available at https://books.google.com/books?id=QrLNCxzynU4C&printsec=frontcover&source=gbs_ge_summary_r&cad=0#v=onepage&q&f=false.

* cited by examiner

MARINE PROPELLER AND METHOD OF DESIGN THEREOF

CROSS-REFERENCE TO RELATED APPLICATION

This application claims the benefit of and priority to U.S. Provisional Patent Application No. 61/871,984, filed Aug. 30, 2013, which is hereby incorporated by reference in its entirety.

FIELD

The present disclosure is related to a propeller for a marine propulsion device. Specifically, the present disclosure is related to particular specifications for a marine propeller which together provide advantageous effects regarding fuel efficiency of a marine vessel propelled by a marine propulsion device having a propeller according to the present disclosure.

BACKGROUND

U.S. Pat. No. 4,865,520, which issued to Hetzel et al. on Sep. 12, 1989, discloses a marine propeller with an addendum. The propeller has a plurality of blades each with an integral addendum extending rearwardly from the trailing edge of the positive pressure surface of the blade. A particular combination of blade area ratio and blade rake is provided to enable quick acceleration to a high speed on plane condition in blade surfacing racing applications, and without bobbing up and down. The blade area ratio is at least 40 percent and the blade rake is 10 to 25 degrees.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

One embodiment of the present disclosure is a marine propeller comprising an outer hub having a central axis and a blade having a blade root attached to the outer hub and extending radially outward from the outer hub toward a blade tip, the blade having a leading edge and a trailing edge. The propeller has a diameter between about 15 inches and about 17 inches and a pitch between about 14 inches and about 24 inches. The blade has a progressive rake angle such that a first local rake angle at the blade root is less than a second local rake angle at the blade tip. A combination of the diameter, pitch, and progressive rake angle provides a marine vessel to which the marine propeller is coupled with minimum drag while the marine vessel is operating at less than a maximum vessel speed.

According to another embodiment of the present disclosure, a method for designing a propeller is disclosed. The method comprises providing a marine vessel having a marine propulsion device powered by an engine and providing a first propeller on a propeller shaft of the marine propulsion device. The method comprises accelerating the marine vessel until it is on-plane, thereafter determining a cruising speed of the marine vessel, and determining a fuel efficiency of the marine vessel at the cruising speed when the first propeller is provided on the propeller shaft. The method also comprises varying one or more specifications of the first propeller to create a subsequent propeller, providing the subsequent propeller on the propeller shaft of the marine propulsion device, accelerating the marine vessel until it reaches the cruising speed, and determining the fuel efficiency of the marine vessel at the cruising speed when the subsequent propeller is provided on the propeller shaft. The method further comprises varying one or more specifications of subsequent propellers, providing the subsequent propellers on the propeller shaft, accelerating the marine vessel until it reaches the cruising speed, and determining the fuel efficiency of the marine vessel at the cruising speed when the subsequent propellers are provided on the propeller shaft, until a maximum fuel efficiency of the marine vessel at the cruising speed is found. The one or more specifications comprise a diameter of the propeller, an expanded blade area ratio of the propeller, a rake angle of a blade of the propeller, and a location of a maximum thickness of the blade of the propeller.

Yet another embodiment of the present disclosure is a marine propeller comprising an outer hub having a central axis and a blade having a blade root attached to the outer hub and extending radially outward from the outer hub toward a blade tip, the blade having a leading edge and a trailing edge. The propeller has a diameter of about 15 inches to about 17 inches and a pitch of one of about 17 inches, about 19 inches, about 21 inches, and about 23 inches. The propeller has an expanded blade area ratio that is related to the pitch such that the expanded blade area ratio is defined by the relationship $EBAR=-0.000104*P^3+0.0063*P^2-0.126*P+1.3946$, where EBAR is the expanded blade area ratio and P is the pitch. The blade has a progressive rake angle such that a first local rake angle at the blade root is less than a second local rake angle at the blade tip. The blade has an average rake angle from the root to the tip that is related to the pitch such that the average rake angle is defined by the relationship $R=0.015625*P^3-1.1942*P^2+29.8951*P-217.545$, where R is the average rake angle. The blade has a maximum cross-sectional thickness at between about 25% and about 40% of a length of a chord extending from the leading edge to the trailing edge.

BRIEF DESCRIPTION OF THE DRAWINGS

The present disclosure is described with reference to the following Figures. The same numbers are used throughout the Figures to reference like features and like components.

DETAILED DESCRIPTION

In the present description, certain terms have been used for brevity, clarity and understanding. No unnecessary limitations are to be inferred therefrom beyond the requirement of the prior art because such terms are used for descriptive purposes only and are intended to be broadly construed.

Figure 1:
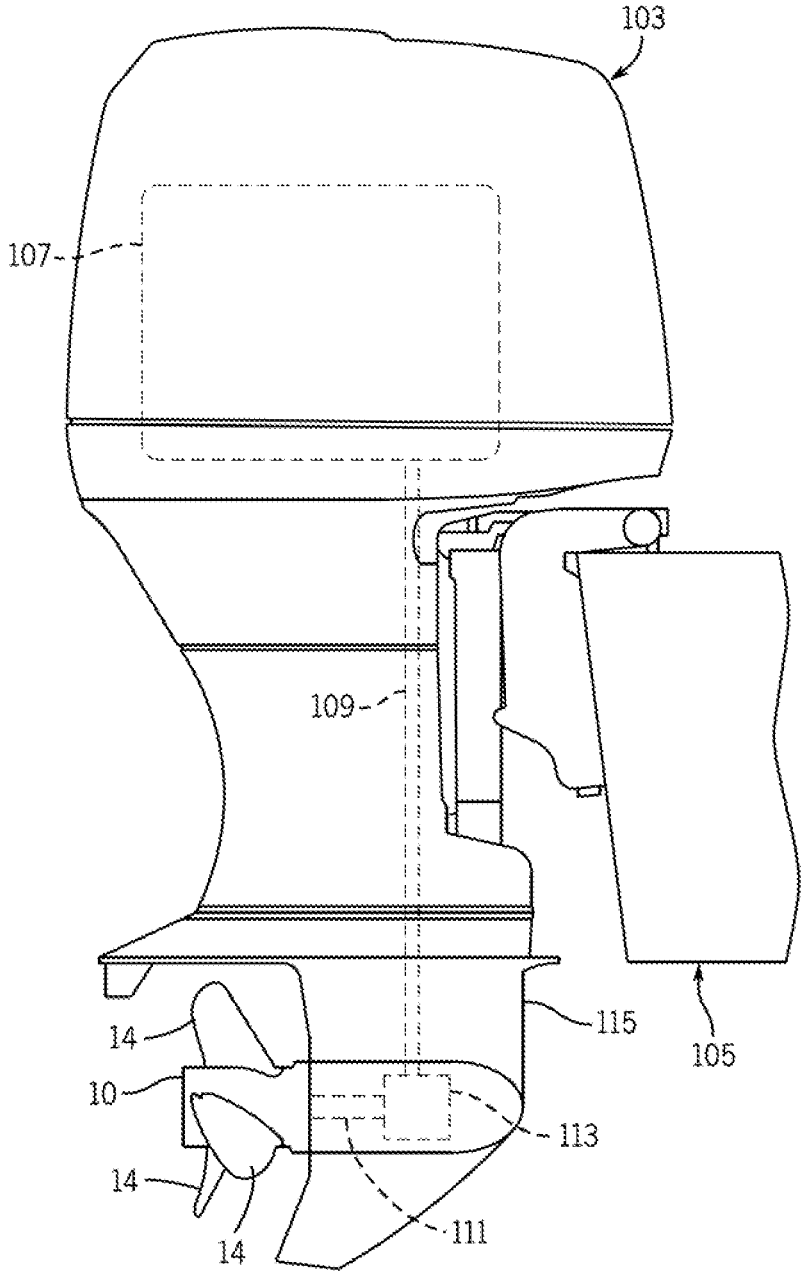
FIG. 1 illustrates a marine propulsion device coupled to a transom of a marine vessel.

FIG. 1 illustrates a marine propulsion device 103 coupled to a transom 105 of a marine vessel (not shown). In the example shown the marine propulsion device 103 comprises an outboard motor having an internal combustion engine 107, which may be a diesel engine or a gasoline engine. Although an outboard motor is shown herein, it should be understood that the present disclosure applies equally to other types of marine propulsion devices, such as stern drives. In the example shown, the engine 107 is coupled in torque transmitting relationship with an output (drive) shaft 109. The output shaft 109 is connected in torque transmitting relationship with a propeller shaft 111 via a shift mechanism 113 located inside a gear case 115. The propeller shaft 111 is coupled to a propeller 10 having a plurality of blades 14.

Figure 2:
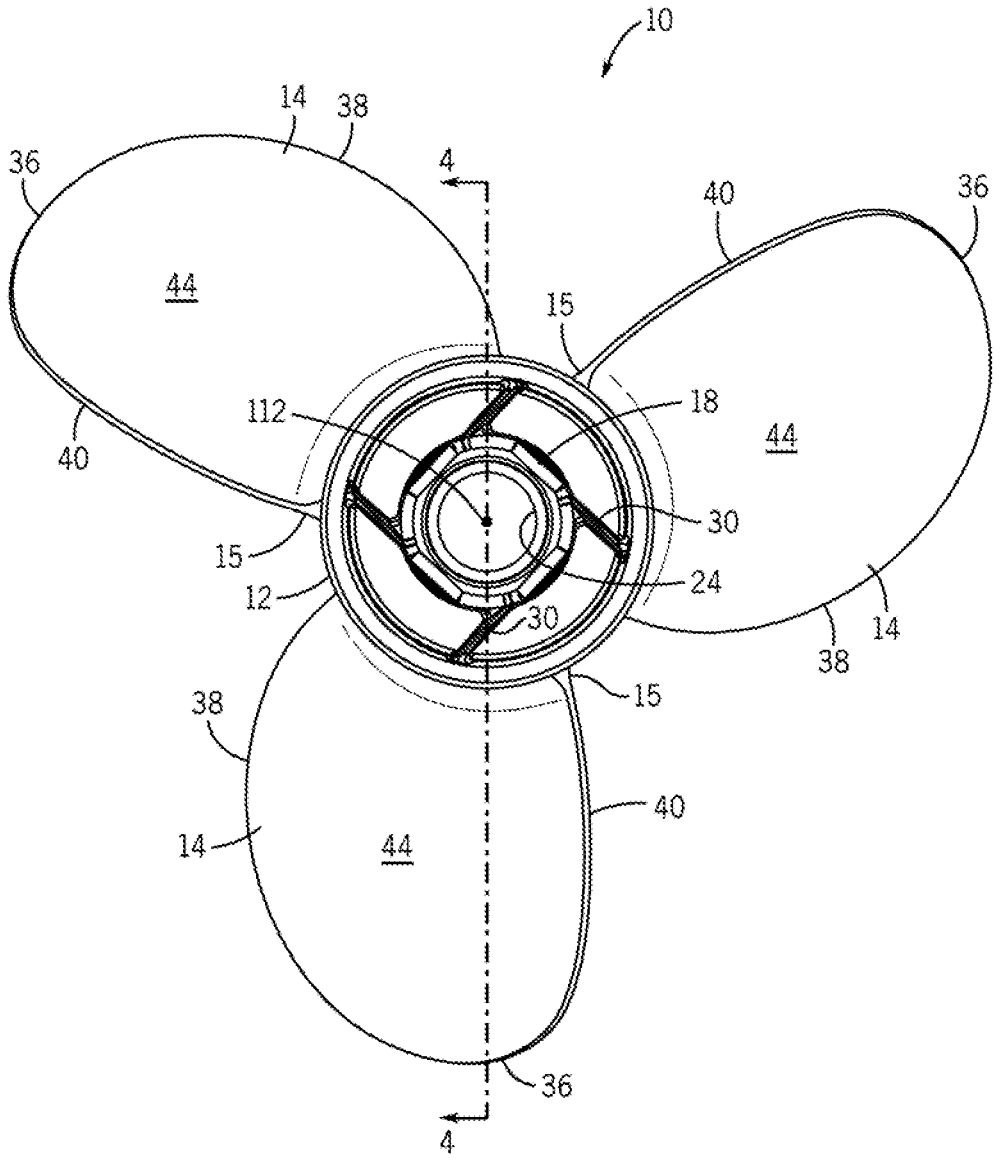
FIG. 2 illustrates a marine propeller according to the present disclosure.

FIG. 2 shows a view of a propeller 10 as seen from a position behind the marine propulsion device (e.g. marine propulsion device 103 in FIG. 1). In the central portion of the propeller 10, an outer hub 12 is attached to a plurality of blades 14. In the propeller 10 illustrated in FIG. 2, an inner hub 18 is rigidly attached to the outer hub 12. An inner radial portion 24 is configured to mate with a propeller shaft (e.g. propeller shaft 111 in FIG. 1) of a marine propulsion device 103. The ribs that connect the outer and inner hubs, 12 and 18, are identified by reference numeral 30. Reference numeral 36 identifies the blade tips, reference numeral 38 identifies the leading edges of the blades 14, and reference numeral 40 identifies the trailing edges of the blades 14. Reference numeral 44 identifies the blade face of each of the blades 14. The opposite surface of each blade 14 is referred to as the blade back.

With continued reference to FIG. 2, the maximum reach of the blade 14 from a central axis 112 of the propeller hubs 12, 18 is the blade tip 36. It separates the leading edge 38 from the trailing edge 40. The leading edge 38 is the part of the blade 14 that is closest to the marine vessel to which the marine propulsion device 103 is attached. It is the first part of the blade that cuts through the water. The leading edge 38 extends from its root 15 at the outer hub 12 to the blade tip 36. The trailing edge 40 is the part of the blade 14 which is farthest from the marine vessel to which the marine propulsion device 103 is attached. It is the edge from which the water leaves the blade 14. It extends from the blade tip 36 to the outer hub 12. The blade face 44 is that side of the blade 14 which faces away from the marine vessel. It is also commonly referred to as the positive pressure side of the blade. The blade back is the side of the blade 14 facing the marine vessel and is commonly referred to as the negative pressure, or suction, side of the blade 14. The blade root 15 is the point at which the blade 14 attaches to the outer hub 12.

Figure 3:
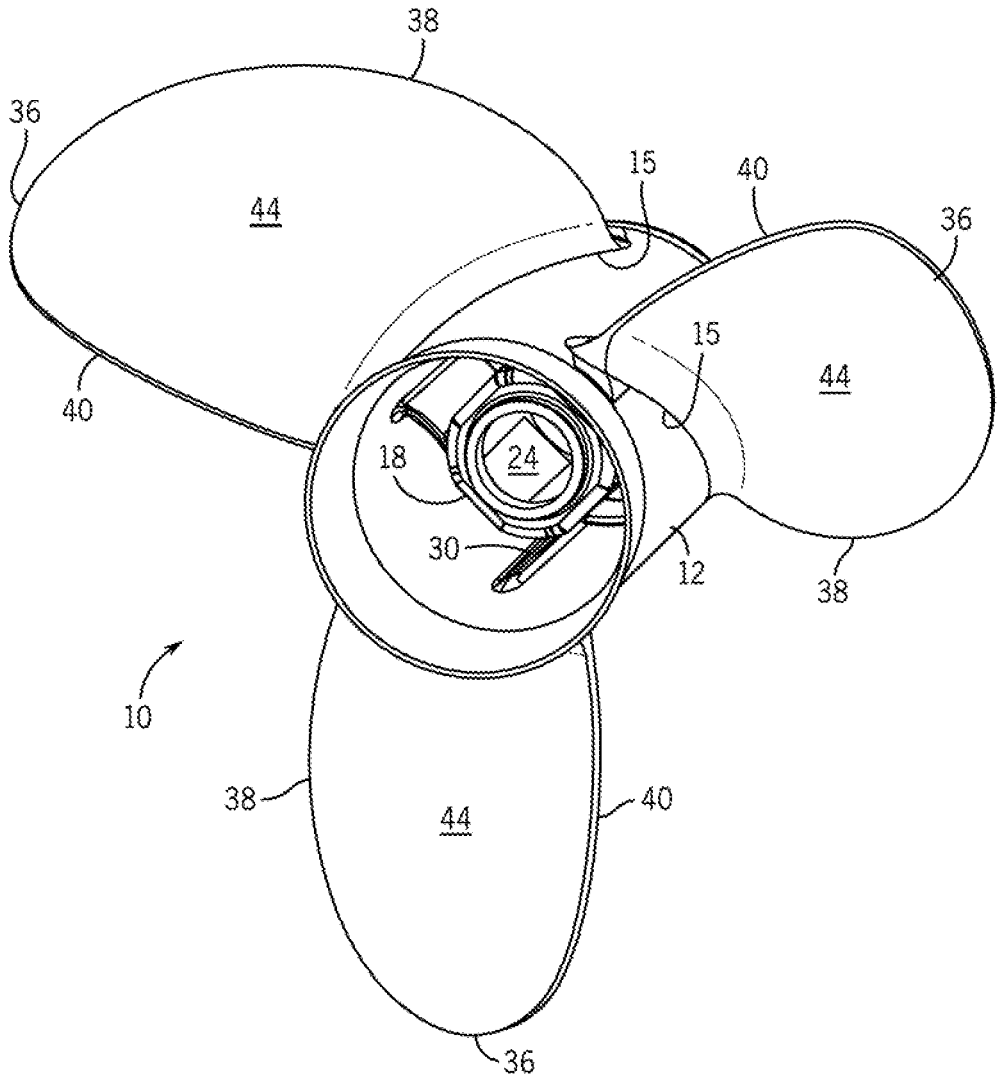
FIG. 3 illustrates an alternate view of a marine propeller according to the present disclosure.

FIG. 3 shows a perspective view of the propeller 10, so as to illustrate another view of the outer hub 12, inner hub 18, and ribs 30. The inner hub 18 typically contains some type of resilient component, such as a rubber hub or an insert sleeve made of plastic material. The forward end of the inner hub 18 is typically a metal surface which generally transmits propeller thrusts through a thrust hub to the propeller shaft 111 and, in turn, to the marine vessel. The outer surface of the outer hub 12 is in direct contact with water. The blades 14 are attached to this outer surface. The inner surface of the outer hub 12 is in contact with the ribs 30 which attach the outer hub 12 to the inner hub 18. This type of propeller can have four ribs 30 as shown, but occasionally has two, three, or five ribs. In an alternative embodiment, no ribs are provided and the outer and inner hubs 12, 18 are connected in another way known to those having ordinary skill in the art.

Figure 4A:
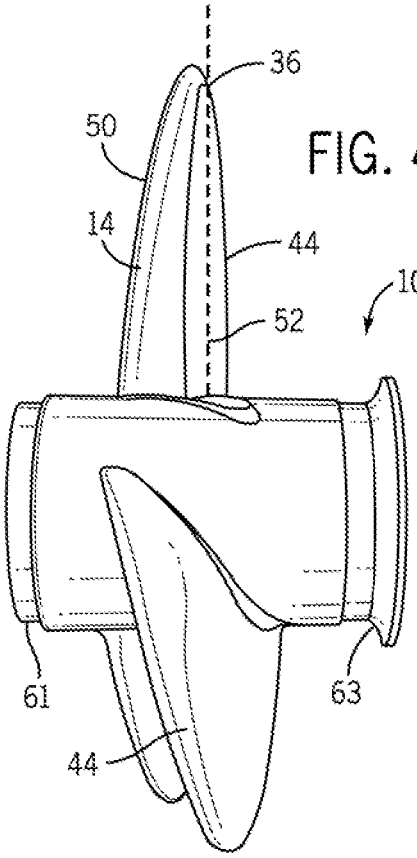
FIGS. 4A-4C show example marine propellers in order to illustrate various alternative propeller design specifications.
Figure 4B:
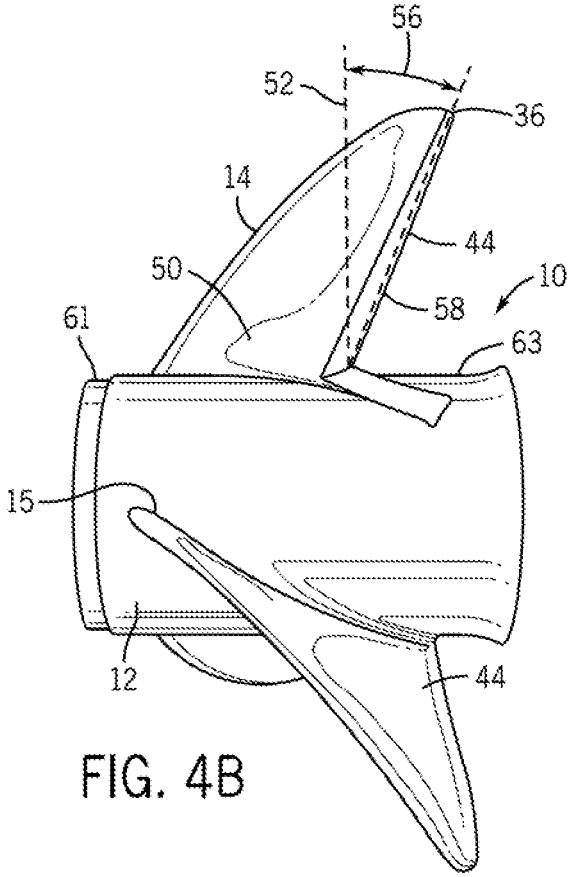
Figure 4C:
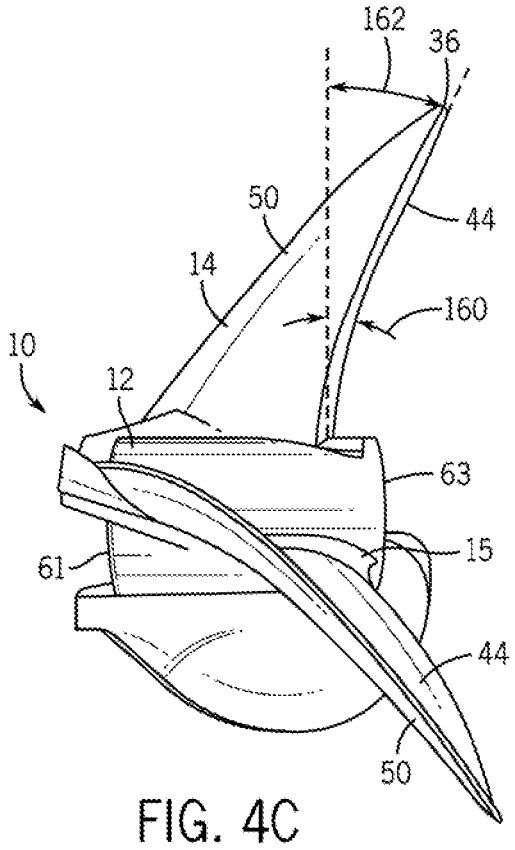

FIGS. 4A, 4B, and 4C, illustrate various types of rake that are possible in propeller designs. Each of these figures shows a section view through a blade 14, wherein the section is a cut taken along a plane that is generally parallel to a central axis (e.g. axis 112 in FIG. 2) of rotation of the propeller 10 and extends through the axis of rotation and the blade tip 36. Each blade 14 has a blade face 44 (positive pressure surface) and a blade back 50 (negative pressure surface). The face side 44 of the cross-sectional surface of that cut, relative to a plane that is perpendicular to the central axis of the propeller, represents the blade rake. If the blade face 44 of the blade 14 is generally perpendicular to the outer hub 12, as represented by dashed line 52 in FIG. 4A, the propeller 10 has a zero degree rake. As the blade 14 slants back toward the aft end 63 of the propeller 10, the blade rake increases. For example, FIG. 4B illustrates a flat rake with an angle represented by arrow 56, i.e., the distance between dashed line 52 and dashed line 58. As described above, this is also the angle between the face side 44 of the cross-sectional surface of the cut blade relative to a plane that is perpendicular to the central axis of the propeller. Dashed line 52 represents the plane that is perpendicular to the central axis of the propeller and dashed line 58 represents the face side 44 of the blade 14. FIG. 4C illustrates a progressive rake that varies, as represented by dimensions 160 and 162, wherein dimension 162 is greater than dimension 160. In most propeller designs, the rake can be either flat, as illustrated in FIGS. 4A and 4B, or curved (progressive) as illustrated in FIG. 4C.

Figure 5:
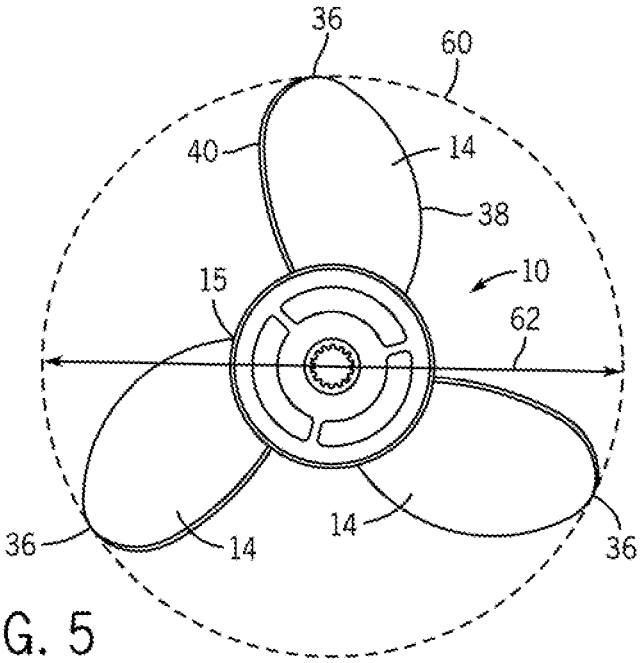
FIG. 5 illustrates an example marine propeller, and shows its diameter in relation to its blade tips.

FIG. 5 shows a propeller 10 with a dashed circle 60 representing a circle made by the blade tips 36 as the propeller 10 rotates. The diameter of that circle 60 is represented by arrow 62 in FIG. 5. The choice of diameter 62 is determined primarily by the rotation speed, measured in RPM, at which the propeller 10 will be expected to turn and by the amount of power that will be delivered to the propeller 10 through the shafts (e.g. drive shaft 109 and propeller shaft 111 in FIG. 1) and gears (e.g. in shift mechanism 113, FIG. 1) used in the marine propulsion device 103 on which the propeller 10 is attached. Also, the degree to which the propeller 10 may operate in a partially surfaced condition, as well as the intended forward velocity of the boat, will also play a role in determining the most desirable diameter 62. Within a particular style of propeller, the diameter 62 usually increases for propellers used on slower boats and decreases for propellers used on faster boats. If all other variables are considered to be constant, the design diameter 62 will typically be increased for increased power and as intended rotational speed (i.e. RPM) decreases. Diameter 62 should also increase as propeller surfacing increases in likelihood.

The pitch of a propeller is the distance that a propeller would move in one revolution if it were moving through a soft solid material, in the manner that a screw moves through a piece of wood. Pitch is the theoretical distance that the boat travels during one complete revolution of the propeller. In other words, a 10 inch pitch propeller would theoretically move the boat 10 inches in the forward direction during one complete revolution of the propeller. Pitch is measured at the face 44 of the blade. A number of factors can cause the actual pitch of a propeller to differ from its identified pitch. Minor distortion of the blades may have occurred during either the casting or cooling process as the propeller was being manufactured. Adjustments or modifications may have been made during repair operations. In addition, undetected damage may alter the pitch of a propeller. Propellers can have a constant pitch or a progressive pitch. Constant pitch means that the pitch is the same at all points from the leading edge 38 to the trailing edge 40. Progressive pitch usually begins as a low magnitude at the leading edge and progressively increases to a higher magnitude of pitch at the trailing edge. The pitch number assigned to a propeller is usually the average pitch over the entire blade.

Other design parameters relating to propellers are the projected area ratio (PAR), the blade area ratio (BAR), and the expanded blade area ratio (EBAR). These numbers represent different ways of measuring the combined area of the blades 14 of the propeller 10 in comparison to the total area of the circle 60 of the same diameter 62. For example, with reference to FIG. 5, the total area of the blades 14 as viewed in the illustration divided by the area of circle 60 would provide a measure of the projected area ratio (PAR). The difference between PAR, BAR, and EBAR will be described in greater detail below.

Figure 6:
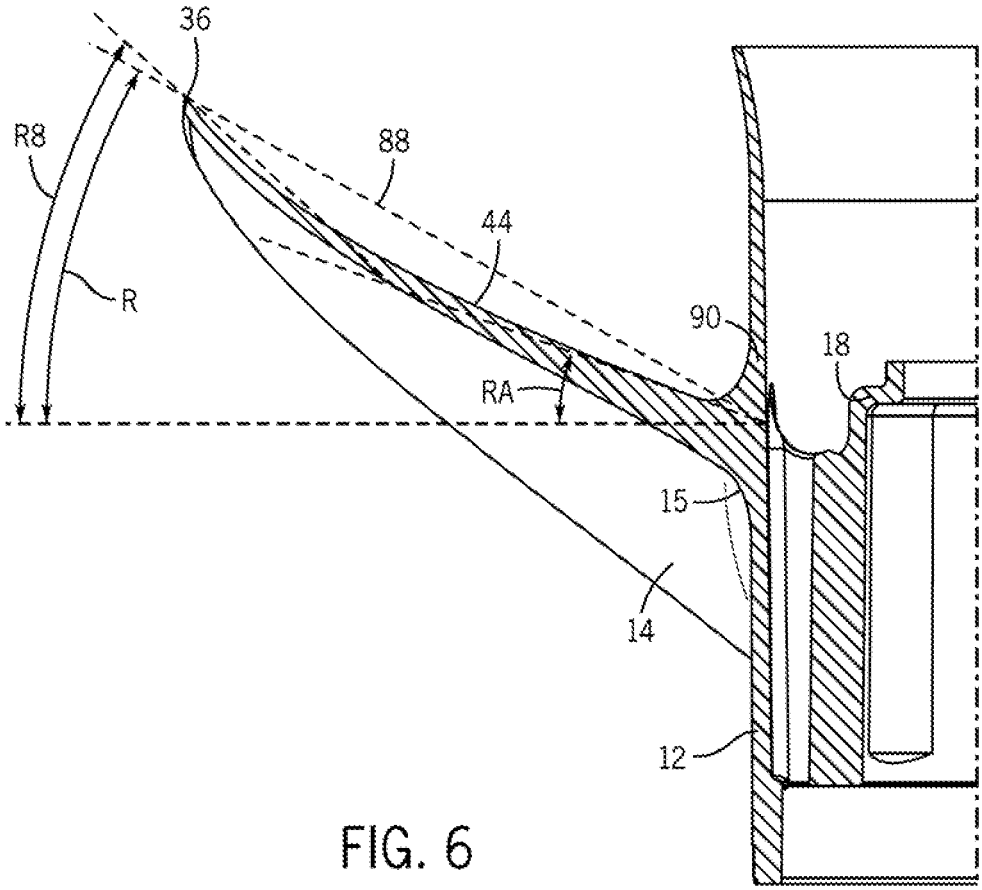
FIG. 6 illustrates a cross section of a blade according to the present disclosure, in order to show its progressive rake.

FIG. 6 illustrates how the rake of the blades 14 was modified to achieve the beneficial effects of the propeller of the present disclosure. The overall rake angle, as identified by the letter R and line 88 in FIG. 6, was constructed to be generally equal to 28 degrees. In addition, each blade 14 was provided with a progressive rake which can be seen by comparing the shape of the blade face 44 with the straight dashed line 88. The rake of the blade face 44 progresses from an angle RA of approximately 20 degrees near the root 90 of the blade 14 to a much greater angle RB of approximately 50 degrees at the tip 36 of the blade. Another way to describe this is to say the radius of curvature of the blade face 44 at the root 90 is greater than at the blade tip 36. The outer hub 12 and a portion of the inner hub 18 are shown in FIG. 6 for purposes of illustrating the shape of the blade 14 in one embodiment of the present disclosure.

Figure 7:
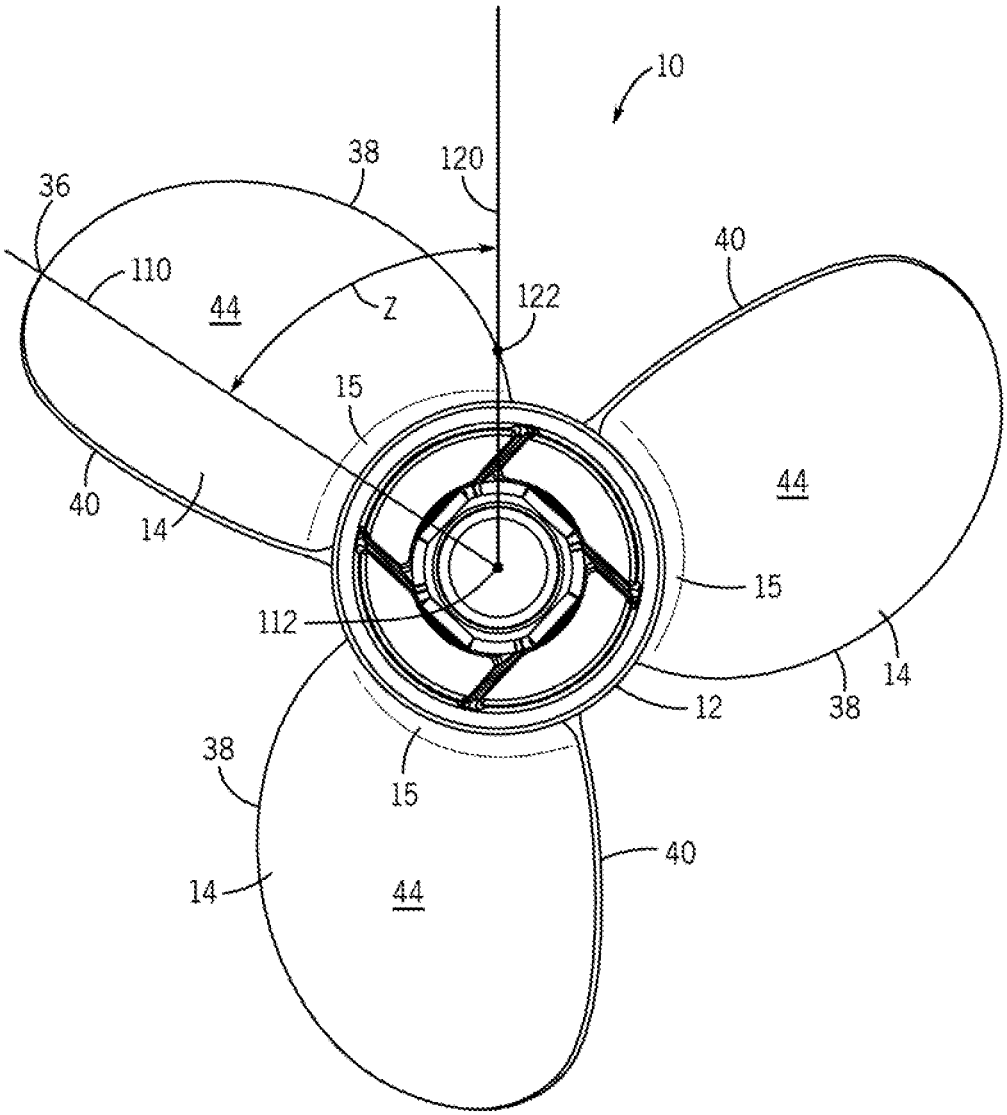
FIG. 7 shows a propeller according to the present disclosure with a line showing where the section of FIG. 6 was taken.

FIG. 7 is included to illustrate the line 110 along which the cross section is taken to illustrate the rake of the blades 14 in FIG. 6. The line 110 extends from the central axis 112 of the propeller 10 to the blade tip 36. In one embodiment of the present disclosure, line 110 is spaced apart from line 120, which extends from the central axis 112 and through a point 122 that is at a 3 inch radius from the central axis 112 and on the leading edge 38 of the blade 14, by an angle Z illustrated in FIG. 7. In one embodiment of the present disclosure, angle Z is approximately equal to 58 degrees.

The description of the embodiments of the present disclosure use numerous terms that are generally known to those skilled in the art. However, in order to avoid any misunderstanding based on potentially alternative definitions of some of these terms, they have been described in detail above. In order to assure that these terms are fully and completely understood, as used to describe one embodiment of the present disclosure, some of them will be further described below.

Figure 8:
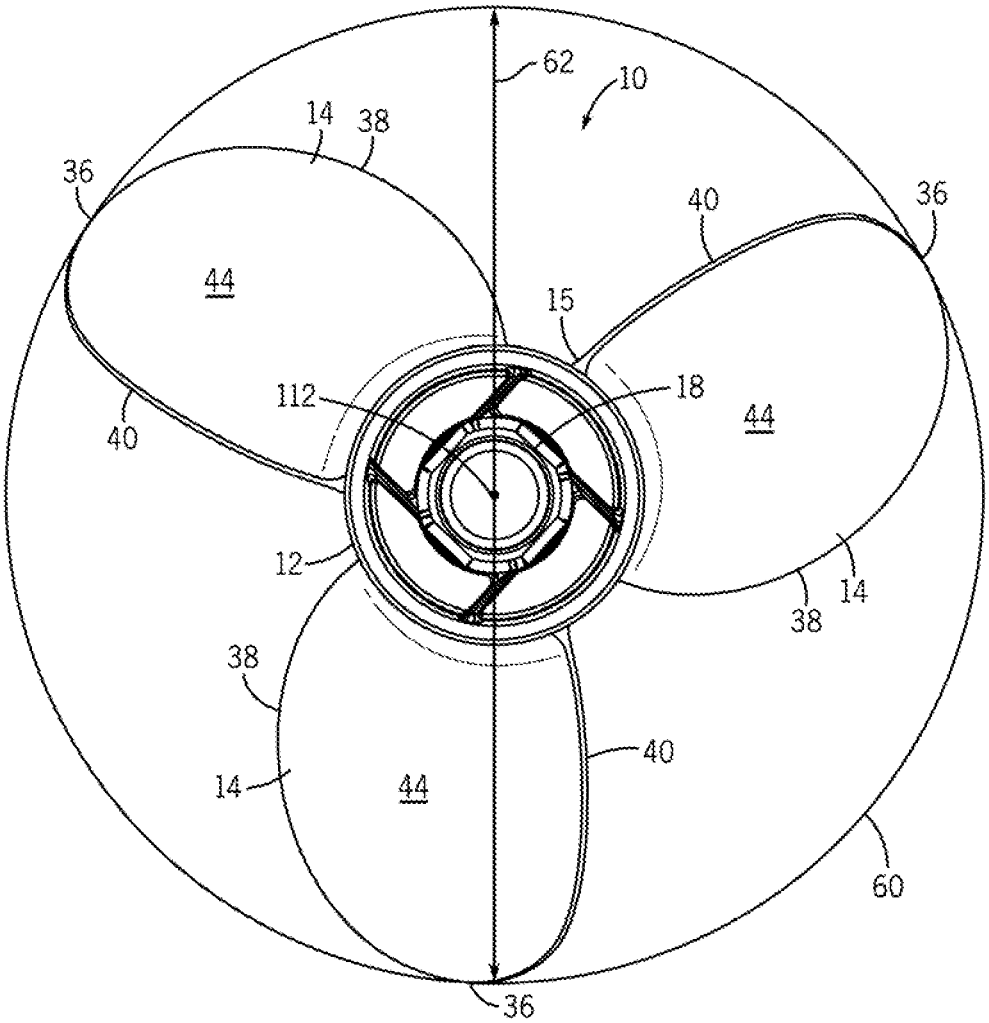
FIG. 8 shows a propeller according to the present disclosure along with a diameter circle relative to its blade tips.

The expanded blade area ratio (EBAR) used to describe the present disclosure differs from the projected area ratio (PAR) or the blade area ratio (BAR) that are sometimes used to describe marine propellers. Those having ordinary skill in the art often define these terms differently and/or use them interchangeably, and therefore a discussion of what is meant by these terms follows with reference to FIGS. 8 and 9. FIG. 8 is an illustration viewed from directly behind the propeller 10 along a line of sight which is parallel to the central axis 112 of the propeller hubs 12, 18 and propeller shaft (e.g. propeller shaft 111 in FIG. 1) to which it is attached. If the total visible area of the three blades in FIG. 8 is divided by the total area of circle 60 connecting the blade tips 36, the resulting percentage is commonly referred to as the projected area ratio (PAR) by those skilled in the art of marine propeller design. However, it should be understood that the blades 14 are disposed at a pitch angle to the surface of FIG. 8 that is perpendicular to the central axis 112. Further, the blades 14 each have camber and rake to them as well. In other words, the visible area of the blades 14 in FIG. 8 is probably significantly less than the actual surface area of those blades 14.

Figure 9:
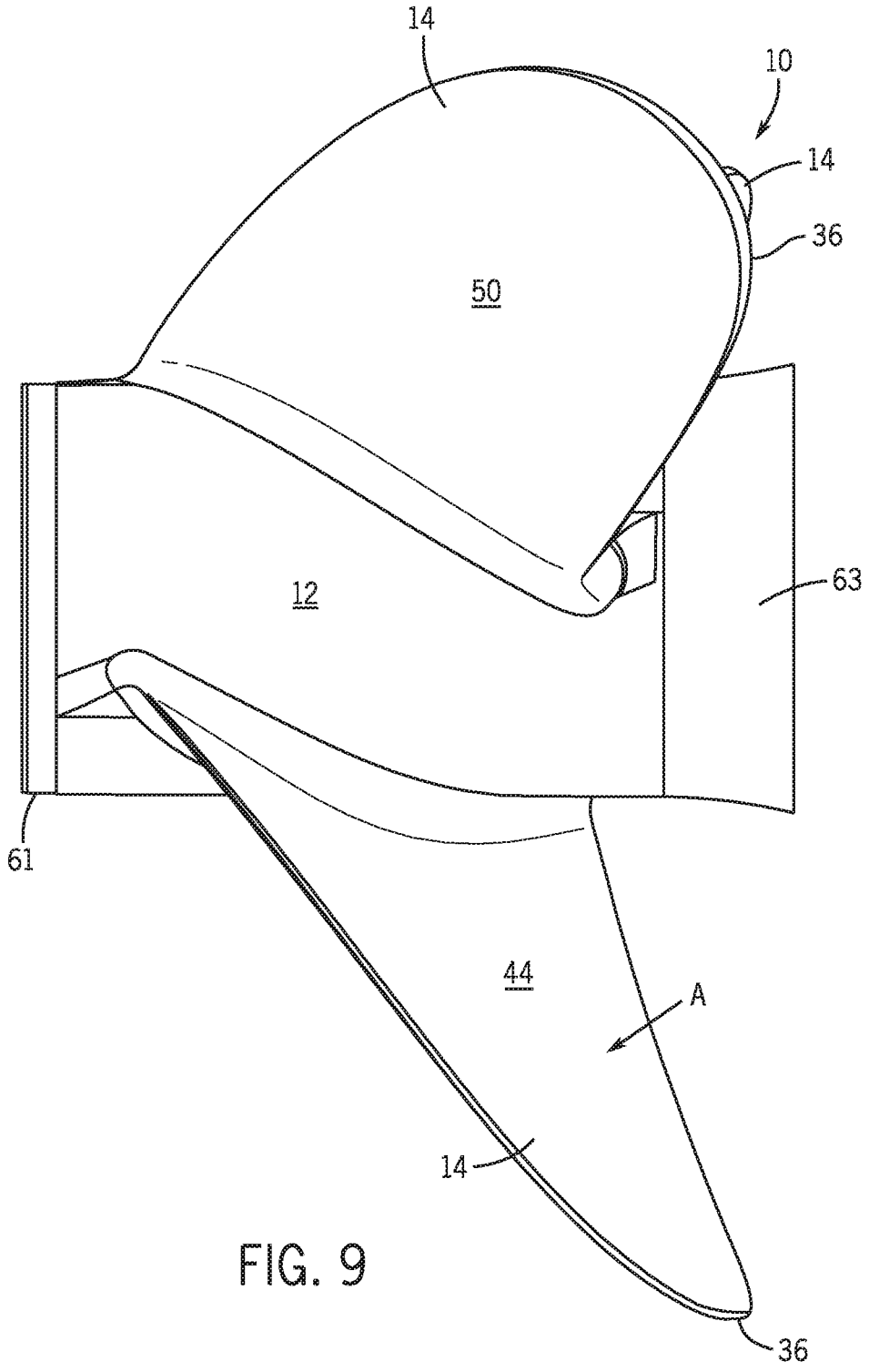
FIG. 9 illustrates a side view of the propeller according to the present disclosure.

FIG. 9 is a side view of a propeller 10 with three blades 14 which are shown extending from the outer hub 12. The front portion of the outer hub 12, identified by reference numeral 61, is shown toward the left in FIG. 9 and the aft end 63 of the outer hub 12 is shown toward the right. As described herein above, the blade face 44 is also known as the positive pressure side of the blade 14. A curved blade back 50 can be seen on the negative, or suction, side of the blade 14. Arrow A represents a direction of viewing the surface area of the blade face 44 of a blade 14. Arrow A is intended to represent one of numerous vectors that are generally perpendicular to each radial section of the pressure surface (blade face 44) of the blade 14. It is recognized that the pressure surface, or blade face 44 of the blade 14, is curved.

The blade area ratio (BAR) may be thought of as the ratio determined by dividing the combined area that would be seen were the pitch of the blades assumed to be zero and the camber of the blades "opened up" (but not the rake). The expanded BAR (EBAR) can be thought of as the ratio determined by dividing the actual combined area of the blades when the pitch of the blades is assumed to be zero, and both the camber and the blade rake have been opened up (i.e., the blades have been completely unfurled), by the total area of the circle 60. The BAR therefore differs from the EBAR, as a blade area which is precisely equal to the total actual curved surface area of the blade faces 44 is used in the calculation of EBAR. In this way, the EBAR accounts for the entire true surface area of the blades 14 in the calculation.

Generally, most propellers are designed for wide open throttle RPM of the engine, top vessel speeds, and acceleration. This usually results in a propeller with reasonable economy at top speed. However, designing a propeller specifically for top speed often results in lower fuel economy while operating at mid-range cruising speeds, because propeller power factor is actually higher at slower speeds. The present inventors are unaware of any propeller designs targeted directly at improving mid-range fuel economy and having specifications chosen to improve fuel efficiency of a marine vessel at cruise conditions, i.e., at less than maximum vessel speed. In one example, cruise conditions are encountered when the marine vessel is operating on-plane, and at a speed that is between about 50% and about 70% of the maximum vessel speed associated with a wide open throttle RPM of the engine. Through research and testing, the present inventors have designed a propeller that improves fuel economy in the cruising speed range without adversely affecting high speed fuel economy or acceleration.

In order to increase fuel efficiency, the drag of the marine vessel/marine propulsion device/propeller combination needs to be reduced. One way to reduce drag is to bring as much of the marine vessel and propulsion device out of the water as possible, thereby reducing surface drag. The propeller of the present disclosure has several specifications that achieve reduced system drag. For example, the diameter of the present propeller is maximized in order to provide the required lift at lower, cruising speeds, and the blades of the present propeller have a high, aggressive rake angle that increases as the tip of the blade is approached. High, aggressive rake and large diameter tend to pull the stern of the marine vessel down, which will in turn raise the bow and reduce drag by reducing skin friction (by reducing wetted area) along the hull of the marine vessel. The present inventors have capitalized on the ability of both higher rake and large diameter to increase performance by holding the bow of the boat higher, resulting in less hull drag. A higher rake angle and large diameter also generally improve the ability of the propeller to operate in a cavitating or ventilating situation, such as when the blades break the water's surface.

Additionally, the present inventors have developed a propeller in which a cross-sectional thickness of the blade is a maximum at 25-40% (e.g. 35%) of a length of a chord extending from the leading edge to the trailing edge along a constant radius measured from the central axis 112. This results in more pressure recovery beyond the maximum thickness point and reduces pressure loss drag. This also represents a departure from a normal 50% to 65% location for a propeller. The present inventors have also determined a relationship between the EBAR of the propeller and its pitch that optimizes fuel efficiency.

Therefore, the present inventors have realized that the combination of specifications including an oversized diameter, a high progressive rake, a large expanded blade area ratio, and a forward biased maximum blade cross-sectional thickness yields mid-range fuel economy gains for a marine vessel to which the propeller is coupled. In one example, a large speed change is seen for a small engine RPM change just after the marine vessel planes off. The present inventors have discovered that this is where fuel economy gains generally are the greatest.

Referring back to FIGS. 2 and 3, the presently disclosed marine propeller comprises an outer hub 12 having a central axis 112 and a blade 14 having a blade root 15 attached to the outer hub 12 and extending radially outward from the outer hub 12 toward a blade tip 36. Blade 14 has a leading edge 38 and trailing edge 40. The propeller 10 has a diameter between about 15 inches and about 17 inches and a pitch between about 14 inches and about 24 inches. Further, with reference to FIG. 6, the blade 14 has a progressive rake angle such that a first local rake angle RA at the blade root 15 is less than a second local rake angle RB at the blade tip 36. The combination of the diameter, pitch and progressive rake angle provides a marine vessel to which the marine propeller is coupled with lesser drag while the marine vessel is operating at less than a maximum vessel speed. In one example, the diameter is between about 15.5 inches and about 16.5 inches. In a further example, the diameter is about 16 inches.

Because the size of a gear case 115 on a marine propulsion device 103 often limits the diameter of a marine propeller 10, and because a larger diameter propeller can provide the geometry to handle the higher power factor, such as encountered at mid-range cruise speeds, the present inventors were faced with the task of providing as much diameter and area for propeller loading as possible, while still allowing the propeller 10 to fit within the gear case 115. Through research and experimentation, the present inventors realized that the expanded blade area ratio (EBAR) could be manipulated by varying the geometry of the blades of the propeller so as to provide enough loading area to ensure fuel efficient operation of the marine vessel at cruise speeds and prevent cavitation inception, yet not so much blade area that the excess area creates more skin friction than necessary.

Figure 10:
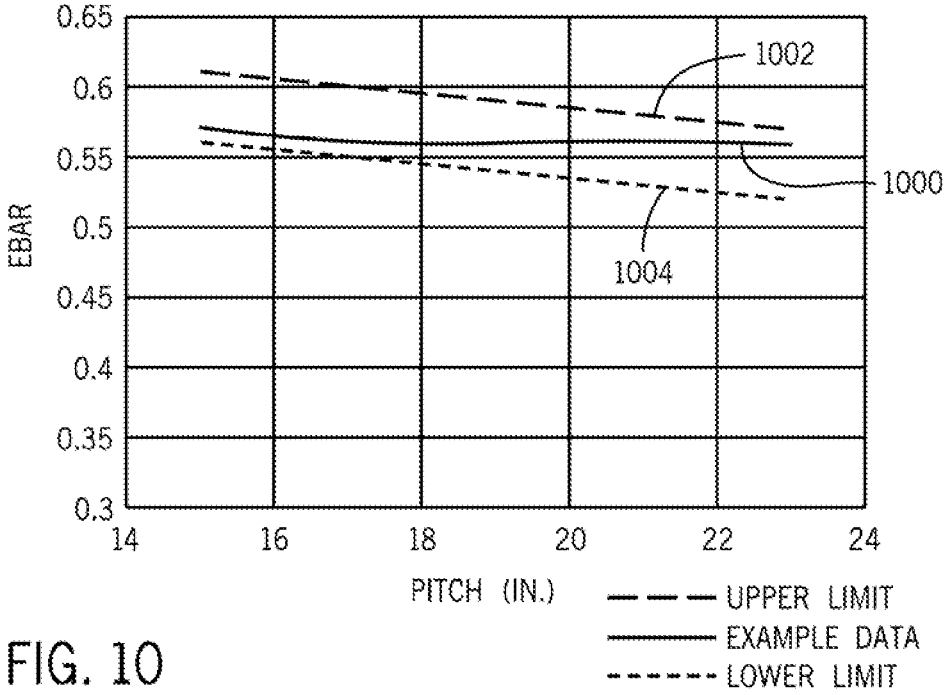
FIG. 10 shows a graphical representation of a relationship between an expanded blade area ratio of the propeller of the present disclosure in relation to its pitch.

With reference to FIG. 10, the present inventors have determined a relationship between the EBAR and pitch of a propeller designed according to the present disclosure, which relationship provides fuel efficient operation of a marine vessel. In FIG. 10, line 1000 represents one example of design specifications for a propeller having a diameter of 16 inches and three blades. Line 1002 indicates a hypothetical upper limit that the present inventors have determined will provide the fuel efficient benefits according to the present disclosure. Line 1004 indicates a hypothetical lower limit that the present inventors have determined will provide the above-mentioned fuel efficiency as well. It can be seen from examination of FIG. 10 that the propeller may have an expanded blade area ratio between about 0.52 (as shown by the lower limit line 1004) and about 0.61 (as shown by the upper limit line 1002). The present inventors have developed a best fit line for the hypothetical upper limit of the relationship between EBAR and pitch as follows:

$$EBAR=-0.005*P+0.685$$

The present inventors have developed a best fit line for the hypothetical lower limit of the relationship between EBAR and pitch as follows:

$$EBAR=-0.005*P+0.635$$

where EBAR is the expanded blade area ratio and P is the pitch.

It can further be seen from FIG. 10 that the example specifications show the EBAR is between about 0.56 and about 0.57, as shown by the line 1000. The example specifications for the relationship between EBAR and pitch can be found in Table 1 below:

TABLE 1

| Pitch (in.) | EBAR |
|---|---|
| 15 | 0.57 |
| 17 | 0.56 |
| 19 | 0.56 |

TABLE 1-continued

| Pitch (in.) | EBAR |
|---|---|
| 21 | 0.56 |
| 73 | 0.56 |

The present inventors developed a best fit line for the example relationship between EBAR and pitch, which best fit line is described by the equation:

$$EBAR=-0.000104*P^3+0.0063*P^2-0.126*P+1.3946$$

Figure 11:
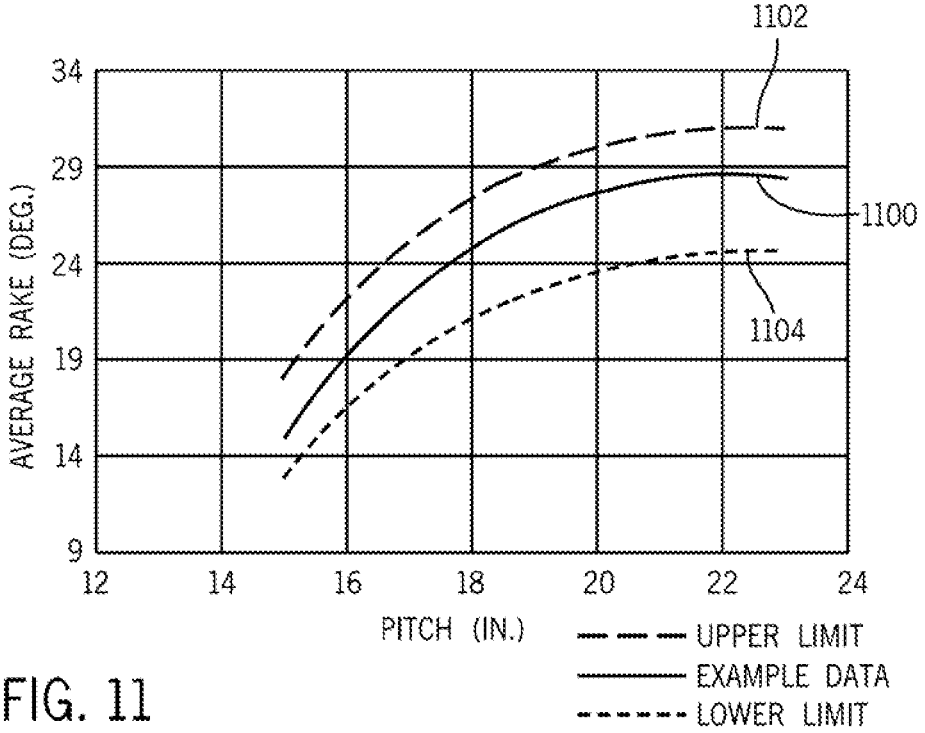
FIG. 11 shows a graphical representation of a relationship between an average rake angle of a blade of the propeller of the present disclosure in relation to its pitch.

The present inventors also realized that by providing a high, aggressive rake angle that increases from a first local rake angle RA at the blade root 90 to a second local rake angle RB at the blade tip 36 (see FIG. 6), the loading surface area of the blade 14 could also be increased, further realizing the effect of increased fuel efficiency of a marine vessel to which the propeller is coupled. The present inventors also determined a relationship between the average rake and pitch of a propeller designed according to the present disclosure, which relationship provides fuel efficient operation of a marine vessel. (The average rake corresponds to the rake from root 90 to tip 36 shown by the line 88 and angle R in FIG. 6.) Turning to FIG. 11, line 1100 represents one example of design specifications for a propeller with a 16 inch diameter and three blades. Line 1102 represents a hypothetical upper limit to a relationship between pitch and average rake that will provide fuel efficient benefits. Line 1104 represents a hypothetical lower limit to the relationship between pitch and average rake that will provide fuel efficient benefits. It can be seen from inspection of FIG. 11 that the blade may have an average rake angle from the root 90 to the tip 36 of between about 12° (as shown by the lower limit line 1104) and about 310 (as shown by the upper limit line 1102). The present inventors have developed a best fit line for the hypothetical upper limit of the relationship between average rake angle and pitch as follows:

$$R=0.02083*P^3-1.4643*P^2+34.372*P-238.44$$

The present inventors have developed a best fit line for the hypothetical lower limit of the relationship between average rake angle and pitch as follows:

$$R=0.02083*P^3-1.42*P^2+32.5506*P-226.209$$

where R is the average rake angle and P is the pitch.

It can further be seen from inspection of the example specifications shown by line 1100 in FIG. 11 that the average rake angle R may be between about 15° and about 29°. The present inventors have realized that the example data can be described by a best fit line that relates the average rake angle to the pitch such that the average rake angle is defined by the relationship:

$$R=0.015625*P^3-1.1942*P^2+29.8951*P-217.545$$

The example specifications for the relationship between pitch and average rake angle can be found in Table 2 below:

TABLE 2

| Pitch (in.) | Average Rake (deg.) |
|---|---|
| 15 | 15 |
| 17 | 22 |
| 19 | 27 |
| 21 | 28 |
| 23 | 28 |

Although the exemplary propeller according to the above examples had a 16 inch diameter and three blades, the presently claimed propeller also encompasses propellers of varying diameter and of fewer or more than three blades, perhaps with slight modifications made to achieve the fuel efficiency benefits of the present disclosure. For example, a propeller with four blades and modified to have the same expanded blade area ratio as the three-blade propeller disclosed herein could be used to achieve similar results.

Figure 12:
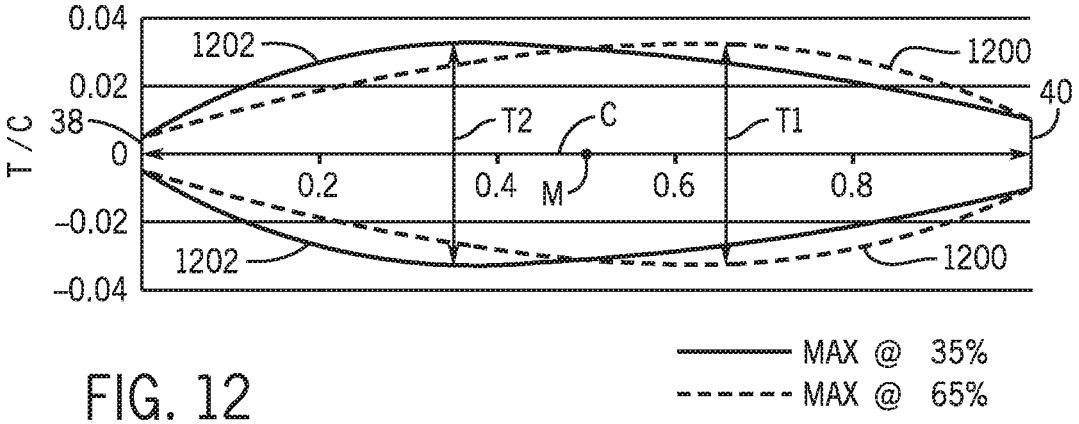
FIG. 12 illustrates a comparison between a cross section of a blade of the propeller of the present disclosure in contrast to an exemplary prior art blade.

Now turning to FIG. 12, the cross-sectional thickness of the blade 14 of a propeller 10 according to the present disclosure will be described. FIG. 12 shows an overlay of cross-sections of two different blades. It should be noted that these cross-sections are exemplary and simplified to illustrate a point about their location of maximum thickness, as explained below. The dashed lines 1200 represent a typical (prior art) blade cross-section. It can be seen that the maximum thickness of the typical blade cross-section is located at about 65% of the length of a chord C extending from the leading edge 38 of the blade to the trailing edge 40 of the blade. This is shown by the thickness T1 located at about 65% of the length of the chord C. In contrast, the blade of the present invention has a cross-sectional shape as shown by solid lines 1202. It can be seen that the maximum cross-sectional thickness (T2) of the blade of the present invention is located at between about 25% and about 40% of a length of the chord C, as measured from the leading edge 38. In one example, the maximum cross-sectional thickness (T2) is located at about 35% of the length of the cord C, as measured from the leading edge 38.

Locating the maximum thickness at a location that is 25-40% of the length of the chord C as measured from the leading edge 38 encourages more pressure recovery beyond the point of maximum thickness and thereby reduces pressure loss drag. On propeller designs with a maximum thickness closer to the trailing edge 40, the water flow tends to separate from the blade, resulting in sheet cavitation where the water detaches from the blade. Sheet cavitation causes a loss of pressure on the back side 50 of the propeller blade 14. If the water instead stayed attached to the blade, the pressure recovery would minimize the drag loss beyond the point of maximum thickness. By moving the maximum thickness forward (e.g. between 25% and 40% of the length of the chord C, as measured from the leading edge 38) a more gradual return to a thin section can be used, thereby minimizing cavitation and allowing the water pressure recovery to reduce pressure drag. Although the present propeller has been described as having the maximum cross-sectional thickness located between about 25% and about 40% of a length the chord C, the maximum cross-sectional thickness could be located at any point between 15% back from the leading edge 38 and a mid-point M of the chord C extending from the leading edge 38 to the trailing edge 40 and could still achieve the above-described effects.

Figure 13:
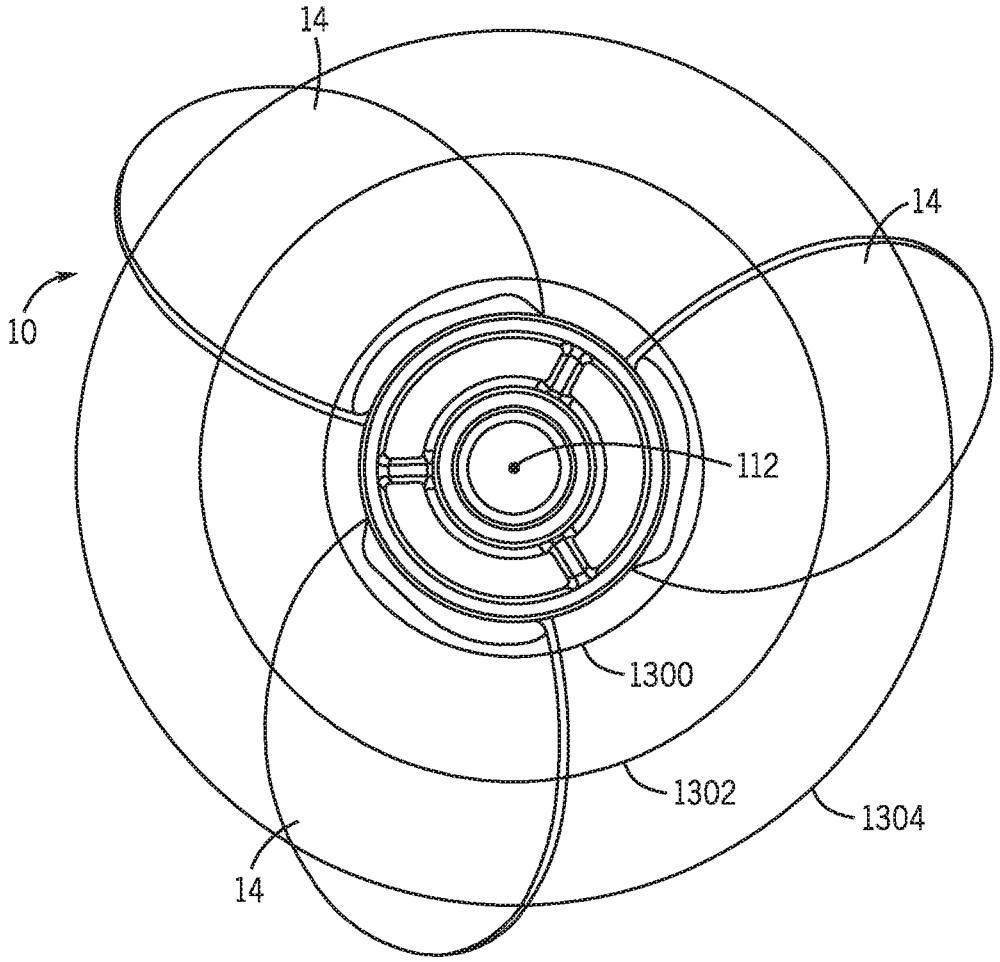
FIG. 13 illustrates several circles showing where the cross sections of the blade shown in FIGS. 14A-14C are taken.
Figure 14C:
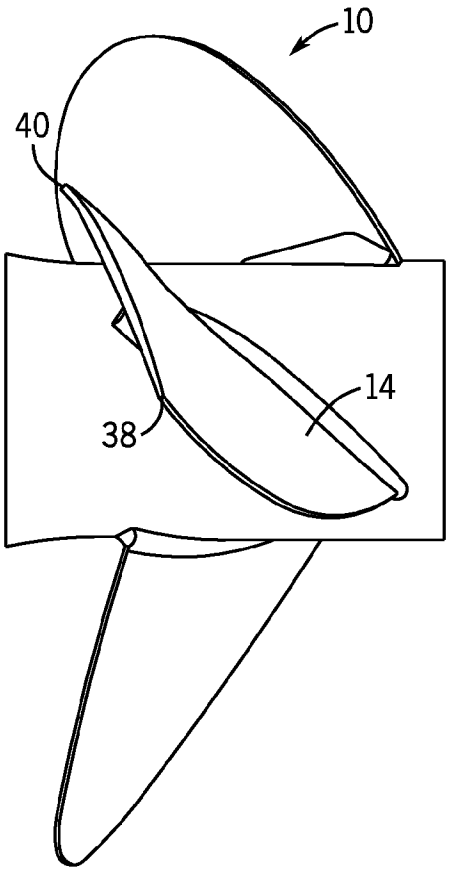
FIGS. 14A-14C show the cross sectional shape of the blade at radial cuts made at 3 inches, 5 inches, and 7 inches from a central axis of the propeller, respectively.
Figure 14B:
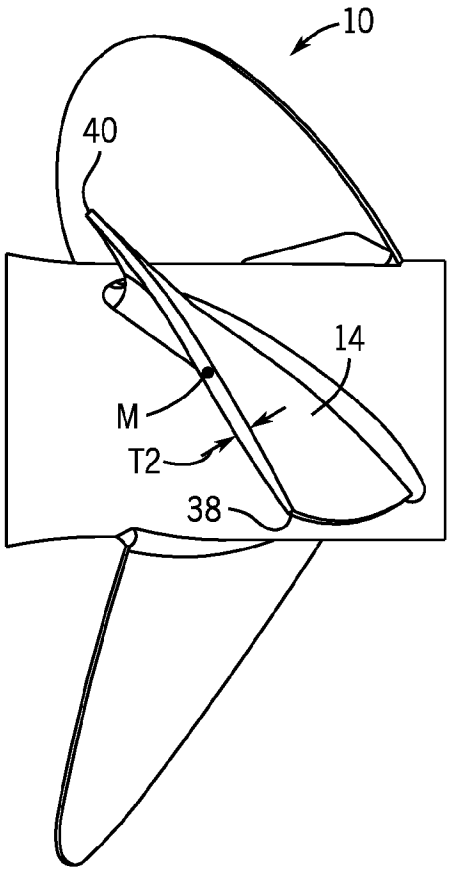
Figure 14A:
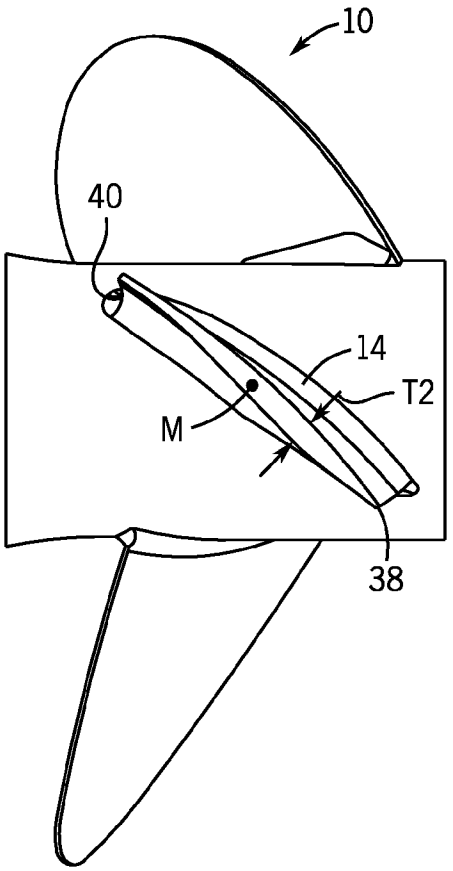

In order to further illustrate the cross-sectional thickness of the blades of the present disclosure, FIGS. 13 and 14A-14C are referenced. FIG. 13 shows a rear view of the propeller 10 and three circles: a first circle 1300 having a radius of 3 inches, a second circle 1302 having a radius of 5 inches, and a third circle 1304 having a radius of 7 inches. Each of these radii is measured from the central axis 112. Referring to FIGS. 14A to 14C, cross-sections taken through the blades 14 at each of the above-mentioned radii are shown. For example, FIG. 14A shows the cross-section of the blade 14 at a radius of 3 inches, as shown by circle 1300 in FIG. 13. It can be seen that the maximum thickness T2 is at the above-mentioned location between the leading edge 38 and the mid-point M of the chord (see FIG. 12) extending from the leading edge 38 to the trailing edge 40. FIG. 14B shows the cross-sectional shape of the blade 14 at the 5 inch radius, as shown by circle 1302 in FIG. 13. Although slightly more difficult to see, the maximum thickness T2 still occurs between the leading edge 38 and the mid-point M of the chord that extends between the leading edge 38 and trailing edge 40. FIG. 14C shows the cross-sectional shape of the blade 14 at the 7 inch radius, as shown by circle 1304 in FIG. 13. FIG. 14C illustrates how as the blade tip 36 is approached, the maximum cross-sectional thickness is no longer as apparent as it was at cross-sections taken at lesser radii.

Figure 15:
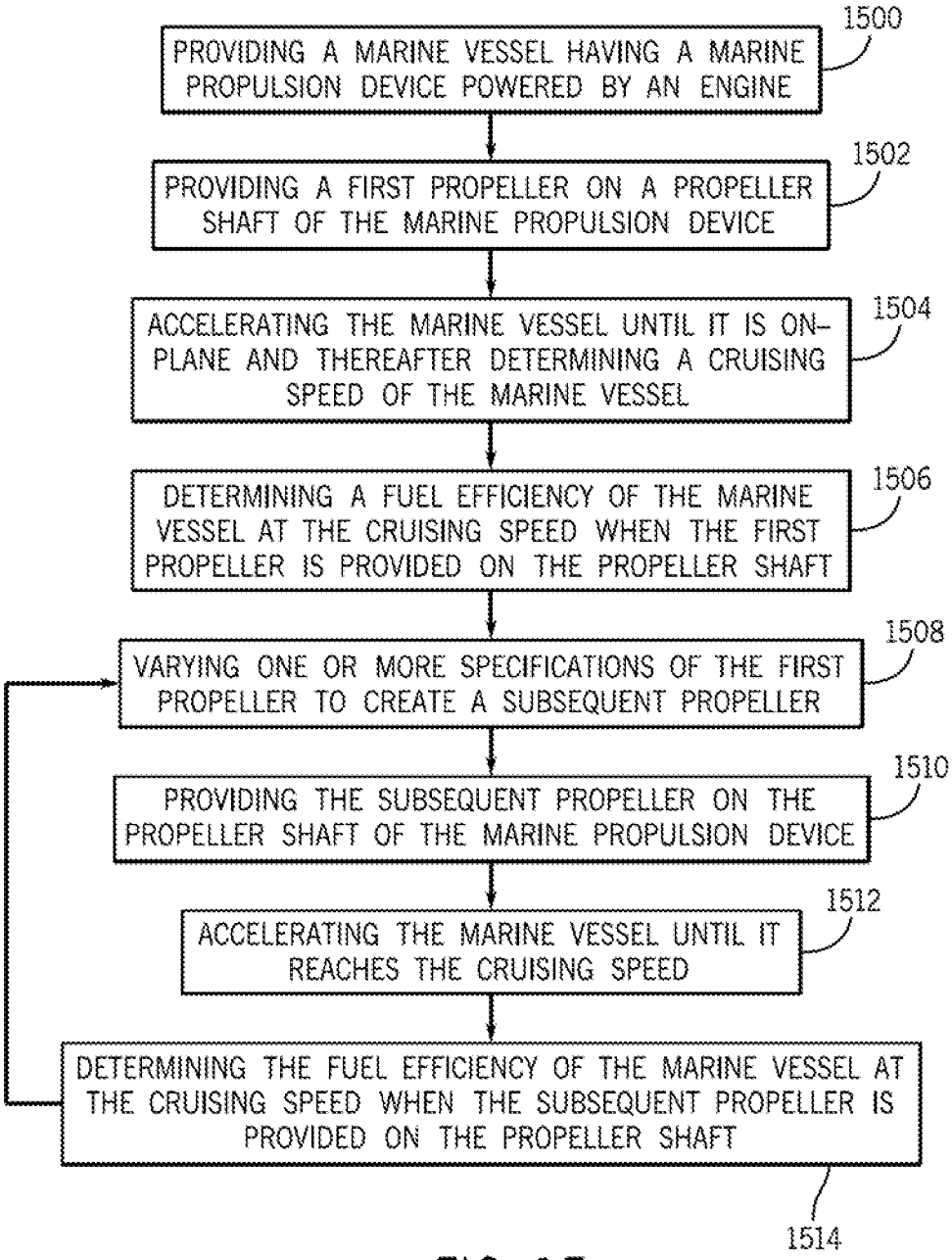
FIG. 15 shows a method for designing a propeller according to the present disclosure.

Now turning to FIG. 15, a method for designing a propeller will be described. As shown at 1500, the method comprises providing a marine vessel having a marine propulsion device 103 powered by an engine 107. The method comprises providing a first propeller on a propeller shaft 111 of the marine propulsion device 103, as shown at 1502. This may involve choosing a propeller having a pitch that is required to achieve a particular speed target, such as a mid-range cruising speed, given the knowledge that as a particular target speed decreases, pitch will also decrease. The diameter can be determined by determining N, P, and V values for a marine vessel operating at cruising speeds, where N is the propeller speed in RPM, P is the power in HP, and V is the velocity. A boat drag vs. speed curve can be estimated using methods from a paper by Daniel Savitsky, Hydrodynamic Design of Planing Hulls, reprinted from Marine Technology, Vol. 1. No. 1, pp. 71-95 (1964). The drag of the gear case can also be estimated and factored in to achieve a total drag vs. speed curve. The total drag vs. speed curve defines the thrust horsepower required for any given speed of the boat. To operate at the best fuel economy, parameters at or near the minimum thrust required should be chosen. From these values, a power coefficient (factor) Bp is calculated, where $Bp=(N*P^{1/2})/V^{2.5}$. The Bp value is located on a Troost chart. This value is followed up to the curve locating the locus of points of maximum efficiency. The corresponding δ value at this point of intersection is then read off the chart. From the value of δ, an ideal diameter D is calculated, where $D=\delta*V/N$. Given the ideal diameter D chosen for the calculations above, the pitch P can be determined using the corresponding P/D ratio.

As mentioned above, the ideal diameter D of the propeller may be larger than the gear case can clear. Therefore, the method may further comprise choosing a propeller having a diameter that is the largest that will fit in a gear case 115 of the marine propulsion device 103 as the first propeller.

As shown at 1504, the method comprises accelerating the marine vessel until it is on plane and thereafter determining a cruising speed of the marine vessel. As mentioned above, the cruising speed is a speed that is about 50-70% of maximum vessel speed. The method comprises, as shown at 1506, determining a fuel efficiency of the marine vessel at the cruising speed when the first propeller is provided on the propeller shaft 111.

The method next comprises varying one or more specifications of the first propeller to create a subsequent propeller, as shown at 1508. In one example, the one or more specifications comprise a diameter of the propeller, an expanded blade area ratio of the propeller, a rake angle of a blade of the propeller, and a location of maximum thickness of the blade of the propeller. The method comprises providing the subsequent propeller on the propeller shaft 111 of the marine propulsion device 103, as shown at 1510. The method comprises accelerating the marine vessel until it reaches the cruising speed, as shown at 1512 and determining the fuel efficiency of the marine vessel at the cruising speed when the subsequent propeller is provided on the propeller shaft 111, as shown at 1514. The method next comprises varying one or more specifications of subsequent propellers, providing the subsequent propellers on the propeller shaft 111, accelerating the marine vessel until it reaches the cruising speed, and determining the fuel efficiency of the marine vessel at the cruising speed when the subsequent propellers are provided on the propeller shaft 111, until a maximum fuel efficiency of the marine vessel at the cruising speed is found. This is shown by the cycling back from 1514 to 1508, and through 1510, 1512, and 1514.

Because the diameter of the propeller may be limited by the size of the gear case, and therefore less than the ideal diameter found according to the equations above, the present inventors developed other ways to effectively increase the loaded area of the propeller. For example, the method may further comprise providing each of the first and subsequent propellers with a progressive rake angle, such that a first local rake angle RA at a root 90 of the blade 14 is less than a second local rake angle RB at a tip 36 of the blade 14. A high rake angle increases the actual surface area of the propeller, as the distance between the radii of curvature along the blade surface is increased by the cosine of the local rake angle (e.g. RA or RB, FIG. 6).

In other examples, the method may further comprise determining the fuel efficiency of the marine vessel at maximum speed, and varying one or more of the above-mentioned specifications until a propeller that achieves fuel efficiency at cruising speeds with no adverse effects on efficiency at maximum speeds is found. The method may further comprise varying the pitch of the propeller for boats with different cruising speeds and testing propellers with various rake angles and EBARs on those boats to determine the most fuel efficient propeller design. For example, the present inventors have designed fuel-efficient propellers having the following specifications found in Table 3:

TABLE 3

| | | | | |
|---|---|---|---|---|
| Pitch (in.) | 17 | 19 | 21 | 23 |
| Diameter (in.) | 16 | 16 | 16 | 16 |
| EBAR | 0.56 | 0.56 | 0.56 | 0.56 |
| Aerage Rake (deg.) | 20 | 27 | 27 | 27 |

Figure 16:
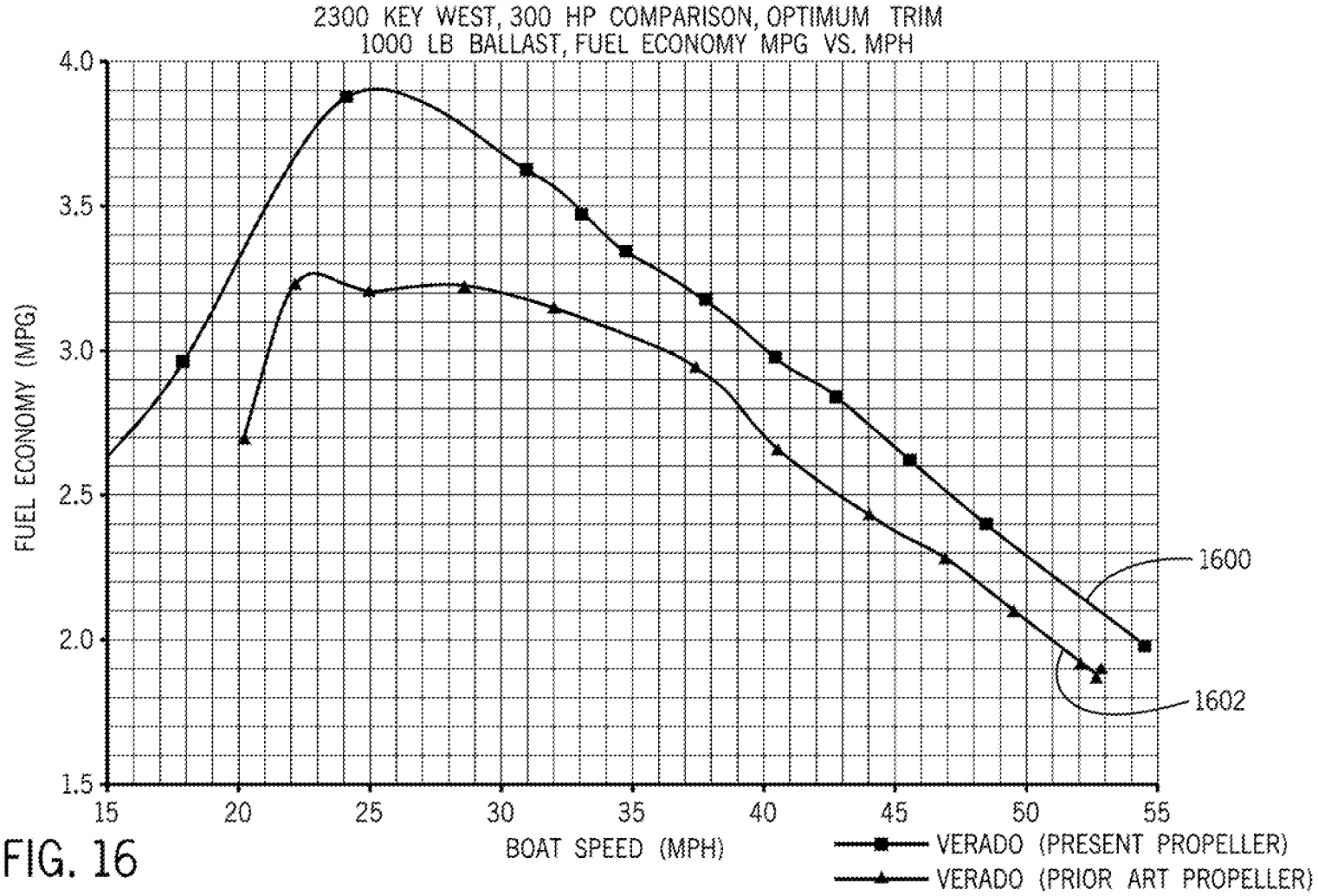
FIG. 16 shows test data illustrating the advantageous effects regarding fuel efficiency of a marine vessel to which a marine propulsion device having a propeller according to the present disclosure is coupled.

Now referring to FIG. 16, actual test data taken from a 2300 Key West boat with a 300 HP engine and 1000 pound ballast will be described. As can be seen in FIG. 16, the fuel economy was graphed as miles/gallon (MPG) on the vertical axis per boat speed in miles/hour (MPH) on the horizontal axis. Line 1600 represents actual test data for a 2300 Key West boat equipped with a Mercury Marine Verado outboard motor with a propeller of the present disclosure coupled thereto. Line 1602 represents the fuel efficiency of the 2300 Key West boat equipped with a Verado outboard motor with a prior art propeller coupled thereto. It can be seen that the fuel efficiency of the boat utilizing the presently claimed propeller is up to about 0.7 MPG more efficient than the same boat utilizing the prior art propeller (see test data taken at 25 MPH). It can be seen that fuel efficiency is especially great at speeds between 25-30 MPH, i.e., when the marine vessel is on plane and at a cruising speed. Further, it can be seen that even at maximum speed conditions, such as for example up to 50 MPH, the present propeller provides fuel efficiency advantages over the prior art propeller.

Although the present inventors obtained test data for the 2300 Key West vessel with a 300 HP engine, it should be understood that the same principles can be applied to a different marine vessel in order to design a propeller that optimizes fuel economy of that marine vessel at its cruising speed. For example, the presently disclosed propeller will achieve fuel-efficient results on marine vessels powered by 150 HP-350 HP engines. (A smaller horsepower engine might require a smaller diameter propeller, if only due to the size of its gear case.) Further, it should be understood that boats can operate at many different cruising speeds, and the cruising speeds described herein should not be limiting on the scope of the present disclosure. In general, the presently claimed propeller is designed to optimize fuel efficiency at the speed at which a marine vessel is likely to travel for a large majority of its on-plane travel time period. As described above, most current propellers are designed for optimization when a marine vessel's engine is at full throttle; however, the present propeller represents a departure from the prior art because it is designed for optimizing fuel economy when the marine vessel's engine is at less than full throttle.

In the above description, certain terms have been used for brevity, clarity, and understanding. No unnecessary limitations are to be inferred therefrom beyond the requirement of the prior art because such terms are used for descriptive purposes and are intended to be broadly construed. The different systems and method steps described herein may be used alone or in combination with other systems and methods. It is to be expected that various equivalents, alternatives and modifications are possible within the scope of the appended claims. Each limitation in the appended claims is intended to invoke interpretation under 35 U.S.C. §112(f), only if the terms "means for" or "step for" are explicitly recited in the respective limitation.

What is claimed is:

1. A marine propeller comprising:

an outer hub having a central axis; and a blade having a blade root attached to the outer hub and extending radially outward from the outer hub toward a blade tip, the blade having a leading edge and a trailing edge;

wherein the propeller has a diameter between 15.5 inches and 16.5 inches;

wherein the propeller has a pitch between about 17 inches and about 23 inches;

wherein the blade has a progressive rake angle such that a first local rake angle at the blade root is less than a second local rake angle at the blade tip;

wherein the propeller has an expanded blade area ratio between about 0.52 and about 0.61;

wherein the expanded blade area ratio is related to the pitch such that an upper limit of the expanded blade area ratio is defined by the relationship EBAR=−0.005*P+0.685 and a lower limit of the expanded blade area ratio is defined by the relationship EBAR=−0.005*P+0.635, where EBAR is the expanded blade area ratio and P is the pitch;

wherein the blade has an average rake angle from the root to the tip, and the average rake angle is related to the pitch such that an upper limit of the average rake angle is defined by the relationship R=0.02083*P^3−1.4643*P^2+34.372*P−238.44 and a lower limit of the average rake angle is defined by the relationship R=0.02083*P^3−1.42*P^2+32.5506*P−226.209, where R is the average rake angle;

wherein the blade has a maximum cross-sectional thickness at a location between about 25% and about 40% of a length of a chord extending from the leading edge to the trailing edge, as measured from the leading edge; and wherein a combination of the diameter, pitch, progressive rake angle, expanded blade area ratio, average rake angle, and location of the maximum cross-sectional thickness minimizes a drag on a marine vessel to which the marine propeller is coupled while the marine vessel is operating at less than a maximum vessel speed.

2. The marine propeller of claim 1, wherein the diameter is about 16 inches.

3. The marine propeller of claim 1, wherein the expanded blade area ratio is between about 0.56 and about 0.57.

4. The marine propeller of claim 3, wherein the expanded blade area ratio is related to the pitch such that the expanded blade area ratio is defined by the relationship EBAR=−0.000104*P^3+0.0063*P^2−0.126*P+1.3946.

5. The marine propeller of claim 1, wherein the average rake angle is between about 12 degrees and about 31 degrees.

6. The marine propeller of claim 5, wherein the average rake angle is between about 15 degrees and about 29 degrees.

7. The marine propeller of claim 6, wherein the average rake angle is related to the pitch such that the average rake angle is defined by the relationship R=0.015625*P^3−1.1942*P^2+29.8951*P−217.545.

8. The marine propeller of claim 1, wherein the maximum cross-sectional thickness is located at about 35% of the length of the chord, as measured from the leading edge.

9. The marine propeller of claim 1, wherein the propeller optimizes fuel efficiency of the marine vessel to which it is coupled when the marine vessel is operating at a speed that is between 50% and 70% of the maximum vessel speed.

10. The marine propeller of claim 1, further comprising three blades attached to the outer hub.

11. A marine propeller comprising:

an outer hub having a central axis; and a blade having a blade root attached to the outer hub and extending radially outward from the outer hub toward a blade tip, the blade having a leading edge and a trailing edge;

wherein the propeller has a diameter of 16 inches;

wherein the propeller has a pitch of one of about 17 inches, about 19 inches, about 21 inches, and about 23 inches;

wherein the propeller has an expanded blade area ratio that is related to the pitch such that the expanded blade area ratio is defined by the relationship EBAR=−0.000104*P^3+0.0063*P^2−0.126*P+1.3946, where EBAR is the expanded blade area ratio and P is the pitch;

wherein the blade has a progressive rake angle such that a first local rake angle at the blade root is less than a second local rake angle at the blade tip;

wherein the blade has an average rake angle from the root to the tip that is related to the pitch such that the average rake angle is defined by the relationship R=0.015625*P^3−1.1942*P^2+29.8951*P−217.545, where R is the average rake angle; and wherein the blade has a maximum cross-sectional thickness at a location between about 25% and about 40% of a length of a chord extending from the leading edge to the trailing edge, as measured from the leading edge;

wherein a combination of the diameter, pitch, expanded blade area ratio, progressive rake angle, average rake angle, and location of the maximum cross-sectional thickness minimizes a drag on a marine vessel to which the marine propeller is coupled while the marine vessel is operating at a speed that is between 50% and 70% of a maximum vessel speed.

12. The marine propeller of claim 11, wherein the expanded blade area ratio is between about 0.52 and about 0.61.

13. The marine propeller of claim 12, wherein the expanded blade area ratio is between about 0.56 and about 0.57.

14. The marine propeller of claim 12, wherein the average rake angle is between about 12 degrees and about 31 degrees.

15. The marine propeller of claim 14, wherein the average rake angle is between about 15 degrees and about 29 degrees.

16. The marine propeller of claim 15, wherein the average rake angle from the root to the tip is about 20 degrees when the pitch is about 17 inches, or is about 27 degrees when the pitch is about 19 inches, about 21 inches, or about 23 inches.

17. A marine propeller comprising:

an outer hub having a central axis; and three blades, each blade having a blade root attached to the outer hub and extending radially outward from the outer hub toward a blade tip, each blade having a leading edge and a trailing edge;

wherein the propeller has a diameter of 16 inches;

wherein the propeller has a pitch of one of about 17 inches, about 19 inches, about 21 inches, and about 23 inches;

wherein the propeller has an expanded blade area ratio of about 0.56;

wherein each blade has a progressive rake angle such that a first local rake angle at the blade root is less than a second local rake angle at the blade tip;

wherein each blade has an average rake angle from the root to the tip of about 20 degrees when the pitch is about 17 inches, or of about 27 degrees when the pitch is about 19 inches, about 21 inches, or about 23 inches; and wherein each blade has a maximum cross-sectional thickness at about 35% of a length of a chord extending from the leading edge to the trailing edge, measured from the leading edge;

wherein a combination of the diameter, pitch, expanded blade area ratio, progressive rake angle, average rake angle, and a location of the maximum cross sectional thickness minimizes a drag on a marine vessel to which the marine propeller is coupled while the marine vessel is operating at a speed that is between 50% and 70% of a maximum vessel speed.

* * * * *